US010265843B2

(12) United States Patent
Young

(10) Patent No.: US 10,265,843 B2
(45) Date of Patent: Apr. 23, 2019

(54) TEMPLATE DEVICE

(71) Applicant: David Christopher Young, Broughton, IL (US)

(72) Inventor: David Christopher Young, Broughton, IL (US)

( * ) Notice: Subject to any disclaimer, the term of this patent is extended or adjusted under 35 U.S.C. 154(b) by 161 days.

(21) Appl. No.: 15/479,845

(22) Filed: Apr. 5, 2017

(65) Prior Publication Data

US 2017/0297193 A1 Oct. 19, 2017

Related U.S. Application Data

(60) Provisional application No. 62/322,438, filed on Apr. 14, 2016.

(51) Int. Cl.
*B25H 7/00* (2006.01)

(52) U.S. Cl.
CPC ..... *B25H 7/00* (2013.01)

(58) Field of Classification Search
CPC . B25H 7/00; B25H 7/005; B25H 7/04; B25H 7/02; E04F 21/26; E04F 21/00; E04F 21/0076; G01B 3/56; G01B 3/08; G01B 5/24; G01B 5/14; G01B 5/02; B43L 7/10
USPC ..... 33/562, 1 G, 415, 452, 455, 456, 459, 33/460, 461, 462, 464, 534, 566
See application file for complete search history.

(56) References Cited

U.S. PATENT DOCUMENTS 1,489,789 A * 4/1924 Ryan ..... E04F 21/26 33/461
1,524,392 A * 1/1925 East ..... G01B 3/56 33/460
1,616,820 A * 2/1927 Owen ..... E04G 21/1891 33/462
1,624,535 A * 4/1927 Christianson ..... E04F 21/26 33/461
2,541,808 A * 2/1951 Schurter ..... B25H 7/005 33/26
2,686,973 A * 8/1954 Christianson ..... E04F 21/26 33/461
3,991,474 A * 11/1976 Rath ..... B43L 7/12 33/462
5,440,818 A * 8/1995 Mailhot ..... B25H 7/02 33/452
6,134,797 A * 10/2000 Boyce ..... B25H 7/00 33/427
7,467,471 B1 * 12/2008 Sutter ..... B43L 9/04 33/194
8,122,611 B1 * 2/2012 Kallsen ..... B43L 7/12 33/462
9,021,713 B1 * 5/2015 Pierson ..... G01B 3/563 33/529
2005/0115091 A1 * 6/2005 Harris ..... B43L 7/10 33/461

* cited by examiner

*Primary Examiner* — Christopher W Fulton
(74) *Attorney, Agent, or Firm* — Gary K. Price

(57) ABSTRACT

A template device including an extendable base having a first part and a second part that are extendable along the device's longitudinal axis. A first swivel is appropriately attached to the first part, and a second swivel is appropriately attached to the second part such that the first swivel and second swivels are disposed on opposite ends of the base. The second part includes a slot having a width sized for frictionally receiving a stud member that extends from the first part, the slot sized and shaped for allowing the stud member to slide along the length of the slot.

17 Claims, 9 Drawing Sheets

TEMPLATE DEVICE

CROSS REFERENCES TO RELATED APPLICATIONS

U.S. Provisional Application for Patent No. 62/322,438, filed Apr. 14, 2016, with title "Template Device" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

The present invention relates to a marking template primarily to be used by carpenters and woodworkers in determining angles without measuring nor application of mathematics.

2. Background Information

In the prior art, marking templates of various kinds are known. However, Applicant is unaware of any such device including all the features and aspects of the present invention.

It would be helpful to carpenters and woodworkers if a template device could be devised that would first allow determining of an angle for primarily making braces or supports for example, that eliminates the need for mathematics, gauging or measuring, and then to simply trace the determined angle to the material for cutting. It is with this need in mind that the present invention was developed.

SUMMARY OF THE INVENTION

The template device generally includes an extendable base having a first swivel and a second swivel. The extendable base being extendable along a longitudinal axis and the first and second swivels generally being vertically adjustable perpendicular to the axis. The extendable base is defined by a first part having the first swivel attached and a second part having the second swivel attached. The second part further includes a slot having a width sized for frictionally receiving a bolt that extends from the first part. The slot sized and shaped for allowing the bolt to slide along the length of the slot.

By loosening the bolt, the second part can be positioned by urging the bolt (and the first part) along the length of the slot thereby extending or shortening the base. When in the desired position, the base may be secured in such position by tightening the bolt with a wing-nut. Each swivel includes an aperture that aligns with apertures disposed on ends of the first and second parts. Each of the apertures are sized for receiving a threaded stud and wing-nut. By loosening the wing-nut for each or either of the swivels, the swivel may then be adjusted at any angle with respect to the base, and when adjusted to the desired position, it may then be secured in such position by tightening the wing-nut.

In application, the user matches the device to the angle to be determined by adjusting the length of the extendable base to the application, and positioning either the first swivel and/or second swivel to match the angle to be determined, and then tightening the wing-nuts. Removing the device, the user can then simply trace the determined angle along the tracing edges to the material (not shown) for cutting.

DESCRIPTION OF THE PREFERRED EMBODIMENT

The present invention is directed to a template-type device with which the accuracy of a specified angle is determined. More particularly, the present invention discloses a template device devised to first determine the specified angle, without the need for applying mathematics or use of a gauge or other measuring device, and then to simply trace the determined angle to the material for cutting. In the broadest context, the template device of the present invention consists of components configured and correlated with respect to each other so as to attain the desired objective.

Figure 1:
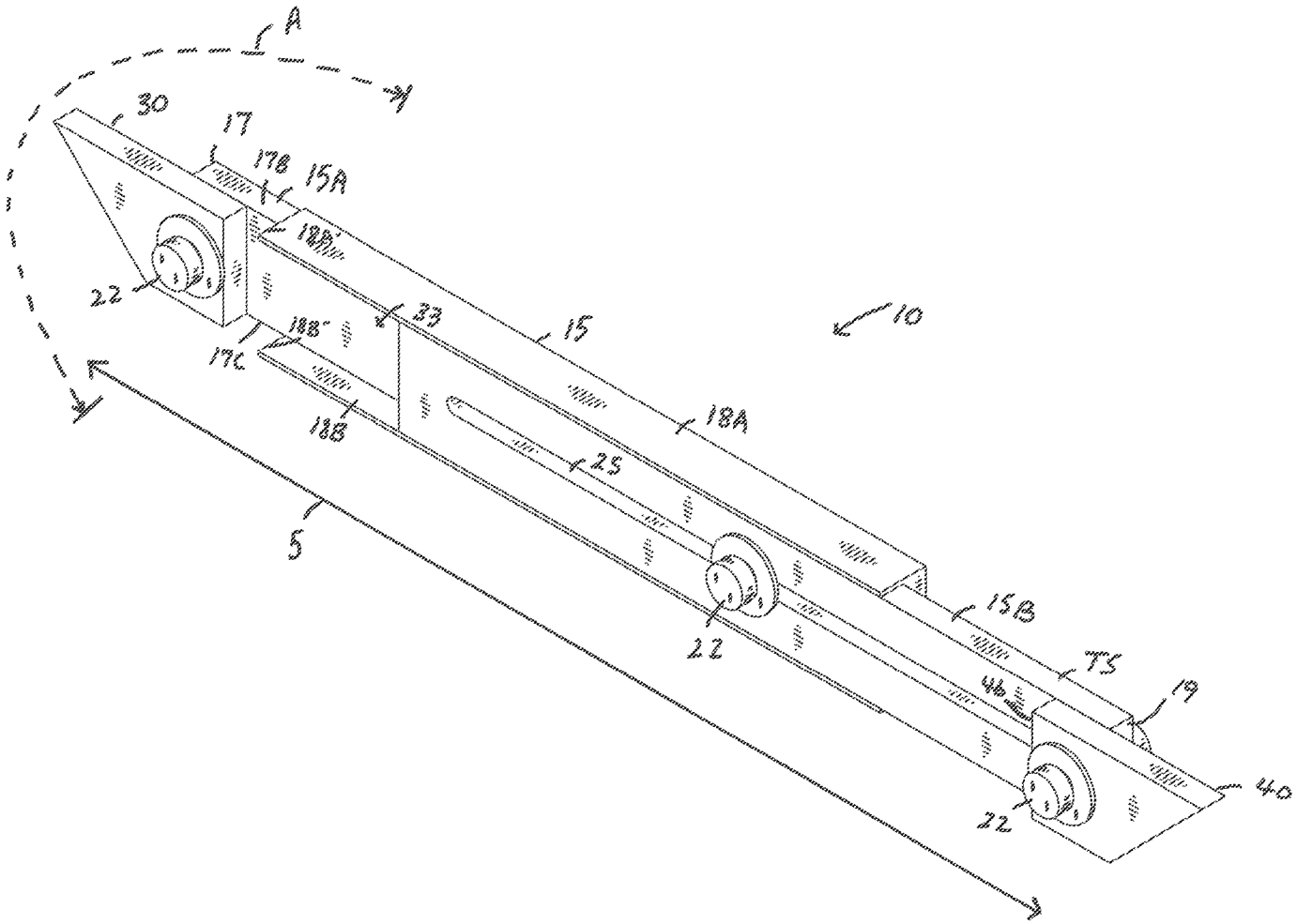
FIG. 1 is a perspective view of the present invention, a template device.
Figure 2:
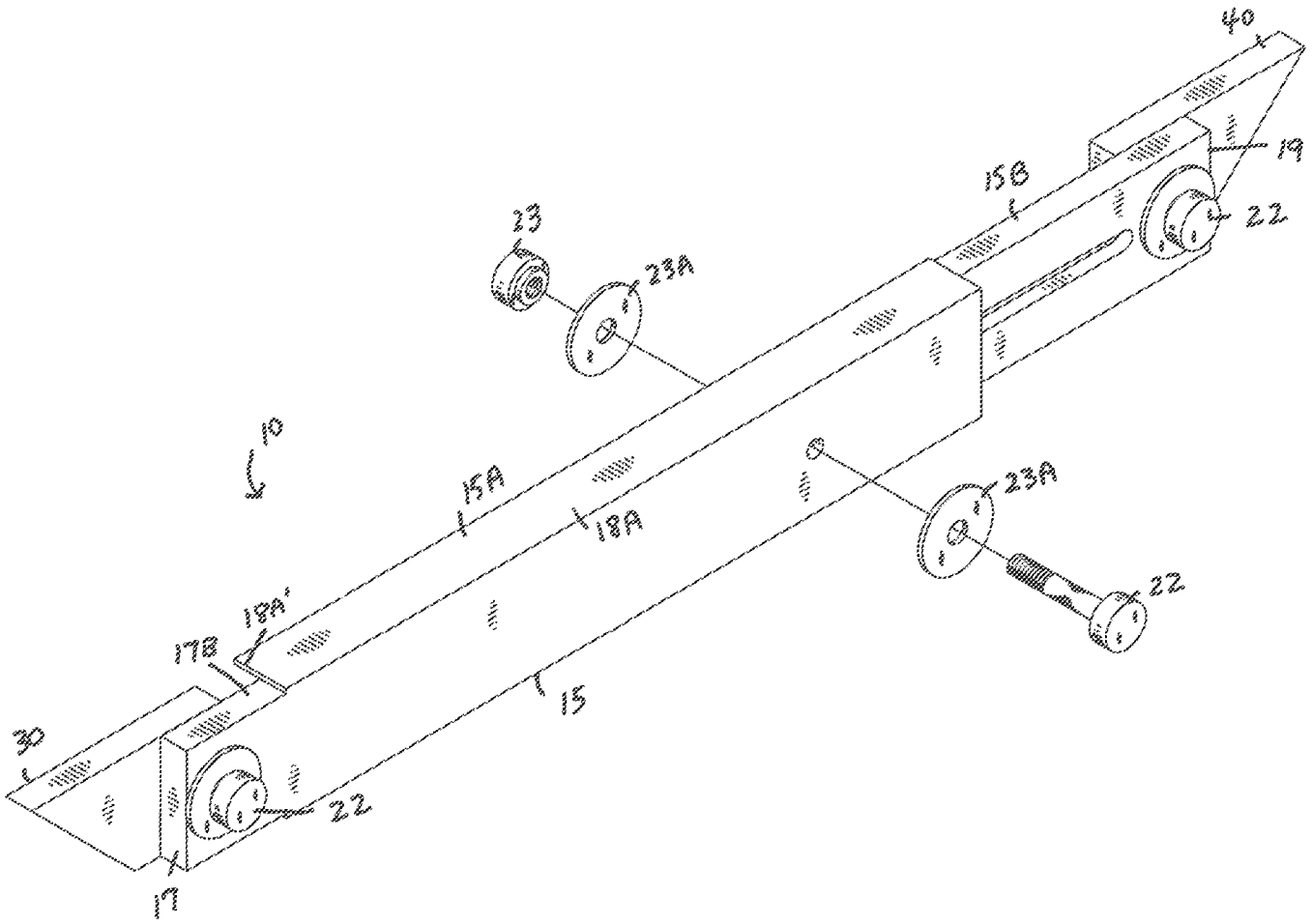
FIG. 2 is a back view of the template device shown in FIG. 1.

Referring to the drawings, the present template device, designated as numeral 10, generally includes an extendable base 15 having a first swivel 30 disposed on a first end 17, and a second swivel 40 disposed on a second, opposite end 19. As will be discussed, the extendable base 15 being extendable along a longitudinal axis 5 and the first and second swivels 30, 40, generally being vertically adjustable along arrow A (see FIG. 1), perpendicular to the axis 5.

The extendable base 15 includes a generally rectangular first part 15A that has the first swivel 30 attached at its end 17 (first end). The first part 15A includes a first aperture 21A positioned adjacent the first end 17 and a second aperture 21B disposed at an opposite end 17A, opposite the first end 17. As will be further described, the apertures 21A, 21B for receiving a bolt 22.

Figure 5:
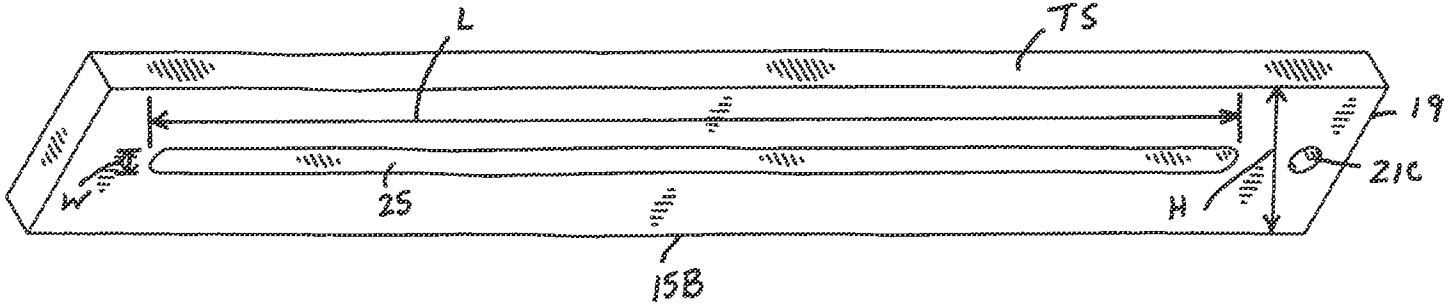
FIG. 5 shows the second part of the template device of FIG. 1.

The base 15 further includes a second part 15B which includes a slot 25 along its planar surface 16. The slot 25 having a width W sized for frictionally receiving the bolt 22, and a length L that extends the approximate length of second part 15B, and the length L is parallel the axis 5 (see FIG. 5). The second part 15B further includes an aperture 21C adjacent the end 19 (second end), opposite end 19A, that attaches with the second swivel 40. The slot 25 sized and shaped for allowing the bolt 22 to slide along the length L of the slot 25. The aperture 21C for receiving a bolt 22.

In application, the second part 15B attaches to the first part 15A by inserting the bolt 22 through the slot 25 and through the aperture 21B and tightening with at least one washer 23A and a nut 23. Preferably the nut 23 is a wing-nut. The base 15 is then horizontally expandable by positioning the bolt 22 (and the first part 15A) along the length of the slot 25.

By loosening the bolt 22 and nut 23, the first and second parts 15A, 15B can be positioned by sliding the bolt 22 along the length L of the slot 25 thereby extending or shortening the length of the base 15 depending upon application and in particular, the length of the slot 25. When in the desired position, the base 15 may be secured in such position by tightening the bolt 22 with the at least one washer 23A and nut 23. Preferably the nut 23 is a wing-nut 23.

When the first part 15A is attached to the second part 15B as described, the first and second swivels 30, 40 are disposed on opposite ends of the base 15 as best shown in FIGS. 1, 2, 4 and 7.

Figure 3:
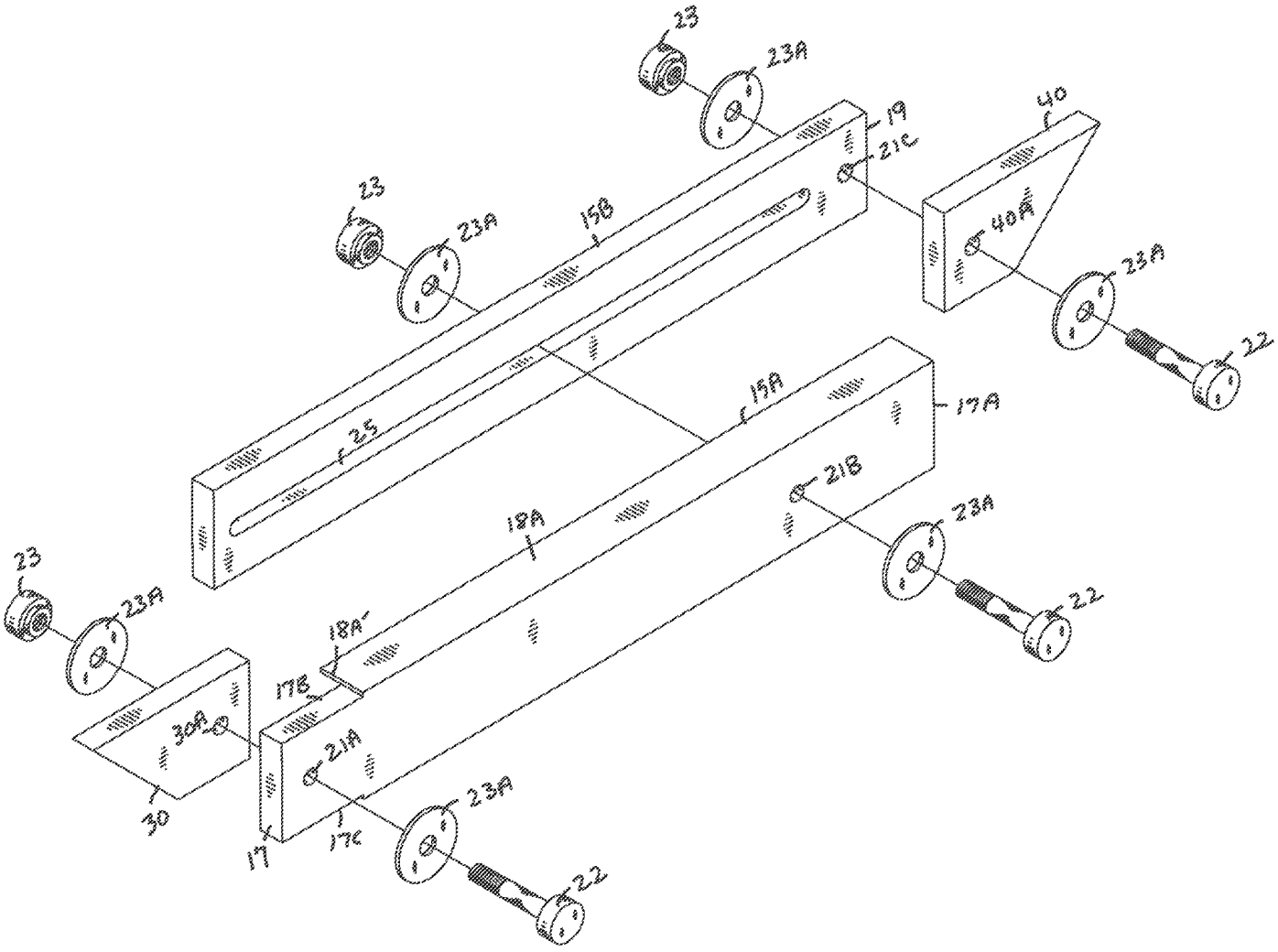
FIG. 3 is an exploded view of the device of FIG. 1.
Figure 4:
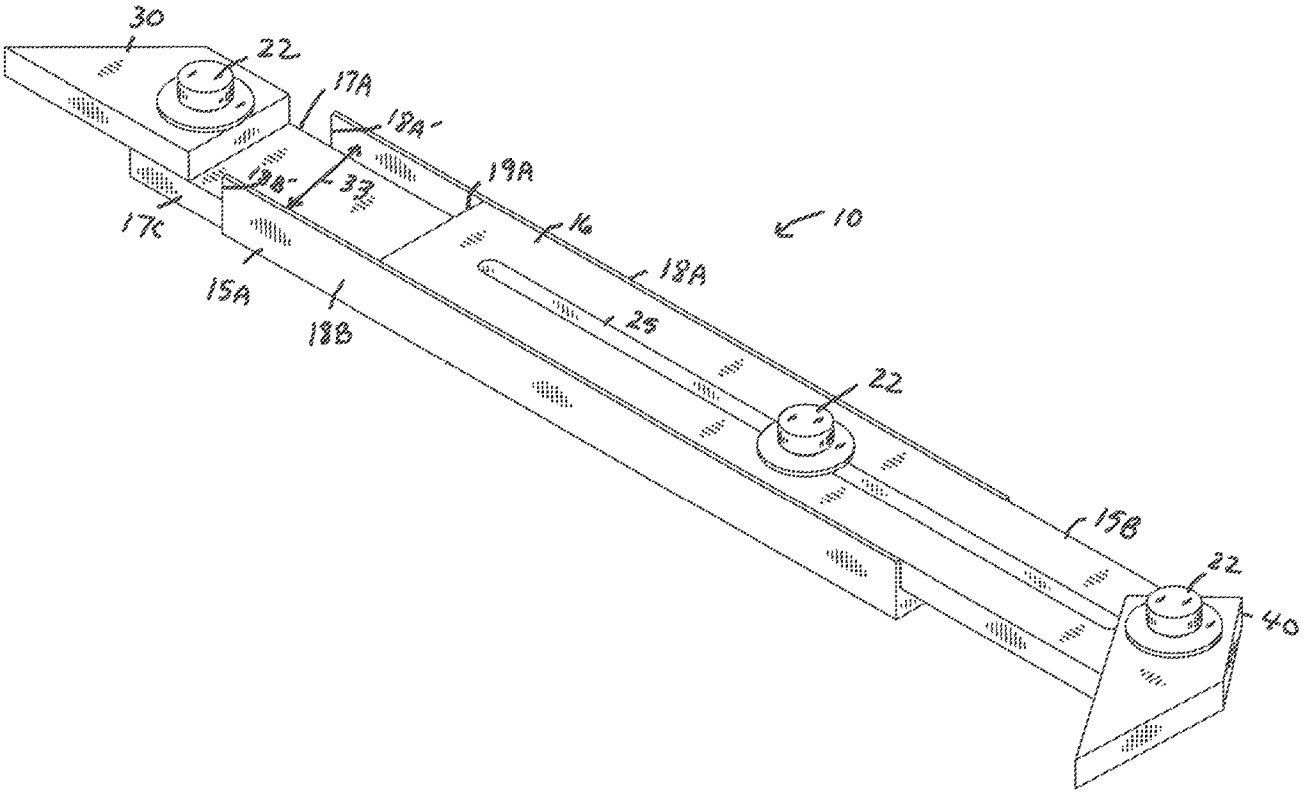
FIG. 4 is a perspective view of the device of FIG. 1.

Each swivel 30, 40 includes an aperture 30A, 40A (see FIG. 3), that in application, aligns with aperture 21A, 21C, respectively, disposed on the ends 17, 19 of the first and second parts 15A, 15B. Each of the apertures 21A, 21C are sized for receiving a bolt 22.

By loosening the wing-nut 32 for each or either of the swivels 30, 40, the swivel may then be vertically positioned along arrow A (see FIG. 1) within limits permitted by its construction, and when adjusted to the desired position, it may then be secured in such position by tightening the wing-nut 32. Each swivel 30, 40, may be adjusted at any angle with respect to the base 15, and fixed or held in such adjusted position by tightening the wing-nut 32 as described.

As illustrated, each of the swivels are identically constructed having the same embodiments. As such, only the embodiments of second swivel 40 will be described, it being understood that the first swivel 30 is identical with the exception that the embodiments for swivel 30 are mirror images of the second swivel 40 embodiments being described.

Figure 6:
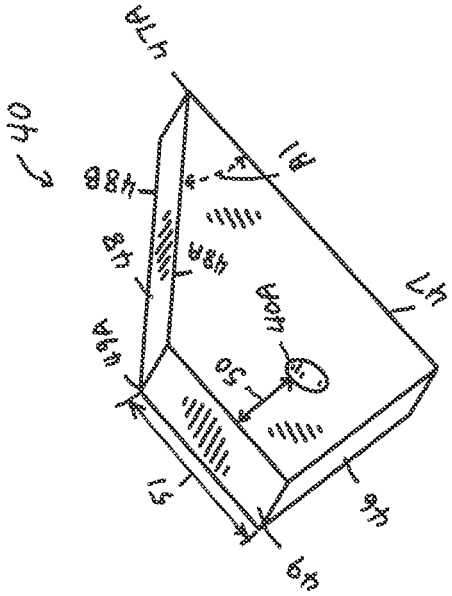
FIG. 6 shows one of the pair of swivels of the template device of FIG. 1.

Referring to FIG. 6, the second swivel 40 is defined by four sides 46, 47, 48 and 49. Side 46 preferably having the approximate same height as the height H of side 19 (see FIG. 5). When attached, side 46 is generally perpendicular to the longitudinal axis 5. Side 47 is perpendicular to side 46 and generally parallel with the longitudinal axis. Similarly, side 49 is perpendicular to side 46 and generally parallel with the longitudinal axis 5.

As illustrated, side 49 has a length 51 that is substantially less than the length of side 47. Side 48 extends from side 47 to side 49, and more particularly, from an end 47A of side 47 to an end 49A of side 49, defining an angle A1 at the intersection of sides 47 and 48. The aperture 40A being disposed at the approximate midway between sides 47 and 49. The angle A1 is an approximate 45 degree angle.

As further illustrated in FIG. 6, there is a defined distance 50 between aperture 40A and side 49 for unimpeded swivel during application. The Inventor has determined it important that the distance 50 be at least equal to or greater than the length 51 of side 49.

Figure 7:
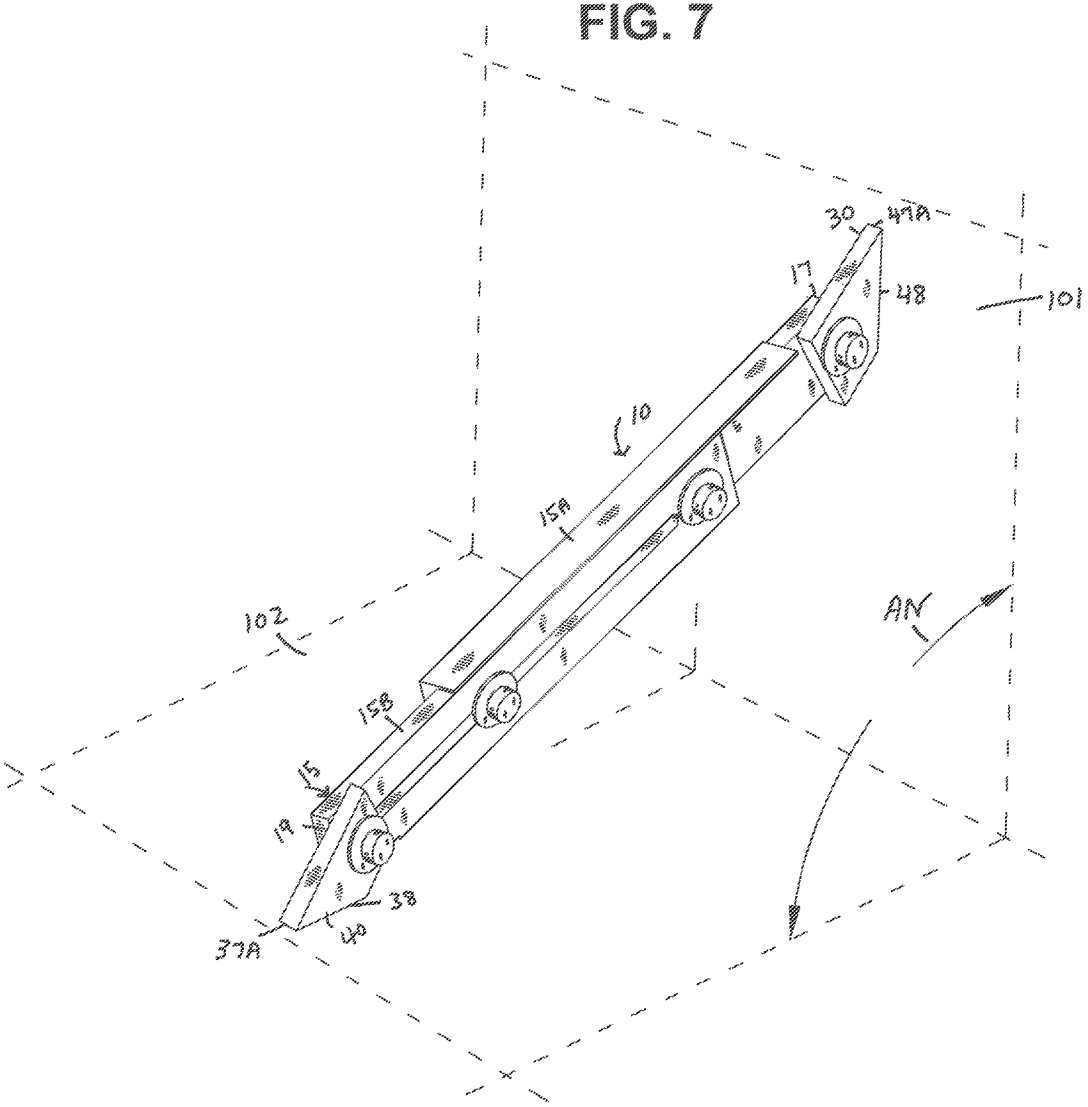
FIG. 7 is a top perspective view that shows application of the device of FIG. 1 with a structure surface illustrated in broken lines.

Referring to FIG. 7, in application, the user matches the device 10 to the structure's angle AN to be determined by adjusting the length of the extendable base 15 to the application as shown. Once the length of the base 10 is determined, the user abuts the side 48 with the structure's first surface 101, and abuts the opposite side 38 with the structure's second surface 102 thereby positioning the first swivel 30 and the second swivel 40 to match the angle to be determined, and then securing the swivels' positions by tightening the wing-nuts 23 as discussed.

Figure 9:
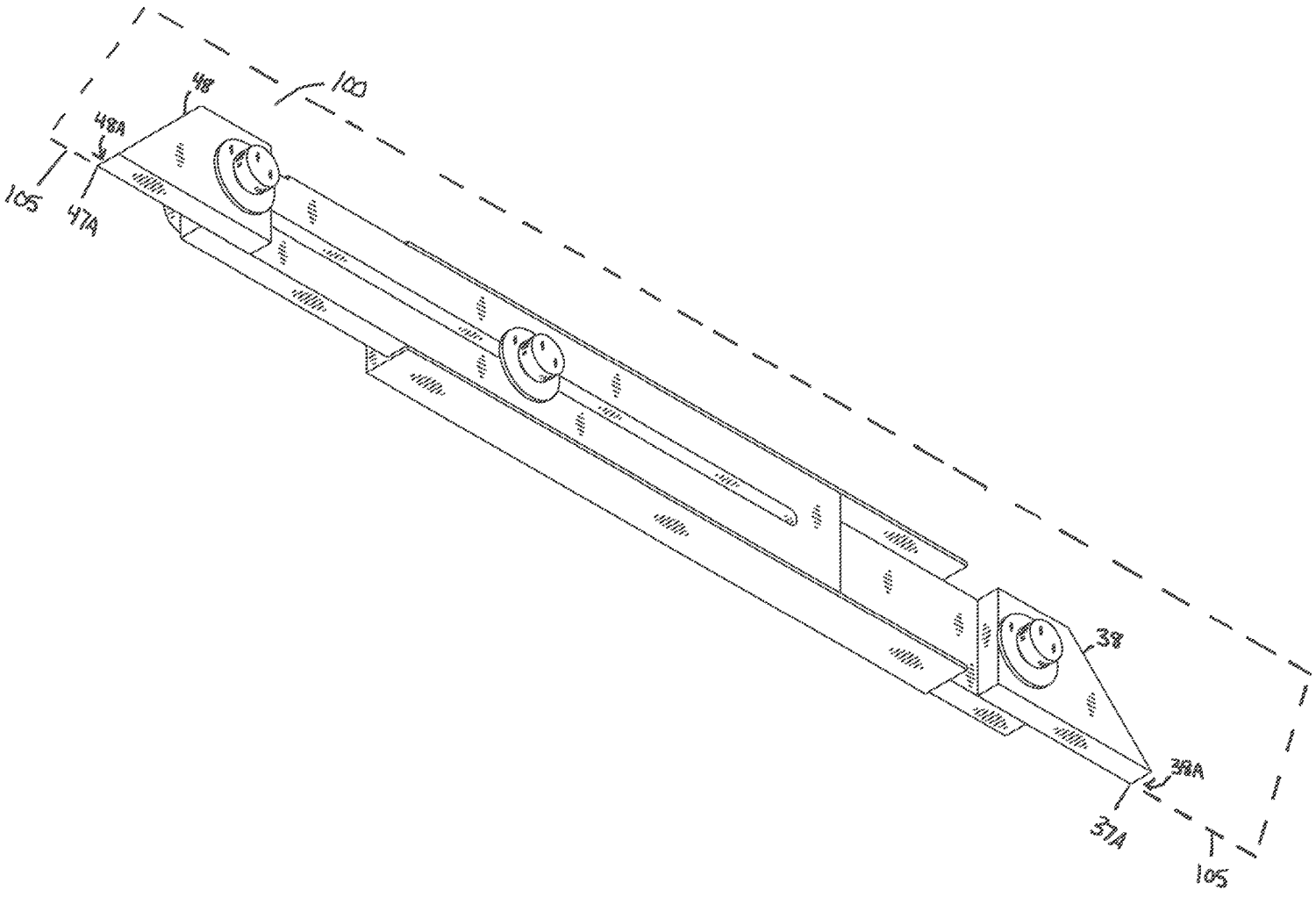
FIG. 9 is a perspective view showing the tracing application or placement of the device once the tracing angles have been determined.

Referring to FIG. 9, removing the device 10, the user then aligns corner ends 47A and 37A with the front edge 105 of the material 100 to be cut and then simply traces the determined angle along either upper tracing edge 48A or lower tracing edge 48B on side 48, and/or either upper tracing edge 38A or lower tracing edge 38B on side 38, whichever upper or lower tracing edges are in abutting contact with the material 100 for cutting. FIG. 6 best shows the upper and lower tracing edges along side 48.

The first part 15A further includes a top side 17B and a bottom side 17C. Sides 17B, 17C extend parallel with axis 5. A top edge 18A is preferably attached to the top side 17B, and a bottom edge 18B is appropriately attached to the bottom side 17C. As illustrated, top edge 18A defines an extending portion 18A' that horizontally extends past the edge of the top side. Similarly, bottom edge 18B defines an extending portion 18B' that horizontally extends past the edge of the bottom side. The top extending portion 18A' and the bottom extending portion 18B' being in parallel relation and forming a guide or track 33 therebetween (best illustrated in FIG. 4) for receiving the second part 15B during application. As should be understood, the portions 18A' and 18B' maintain and guide the second part 15B while adjusting the length of the extendable base 15 as described.

Figure 8:
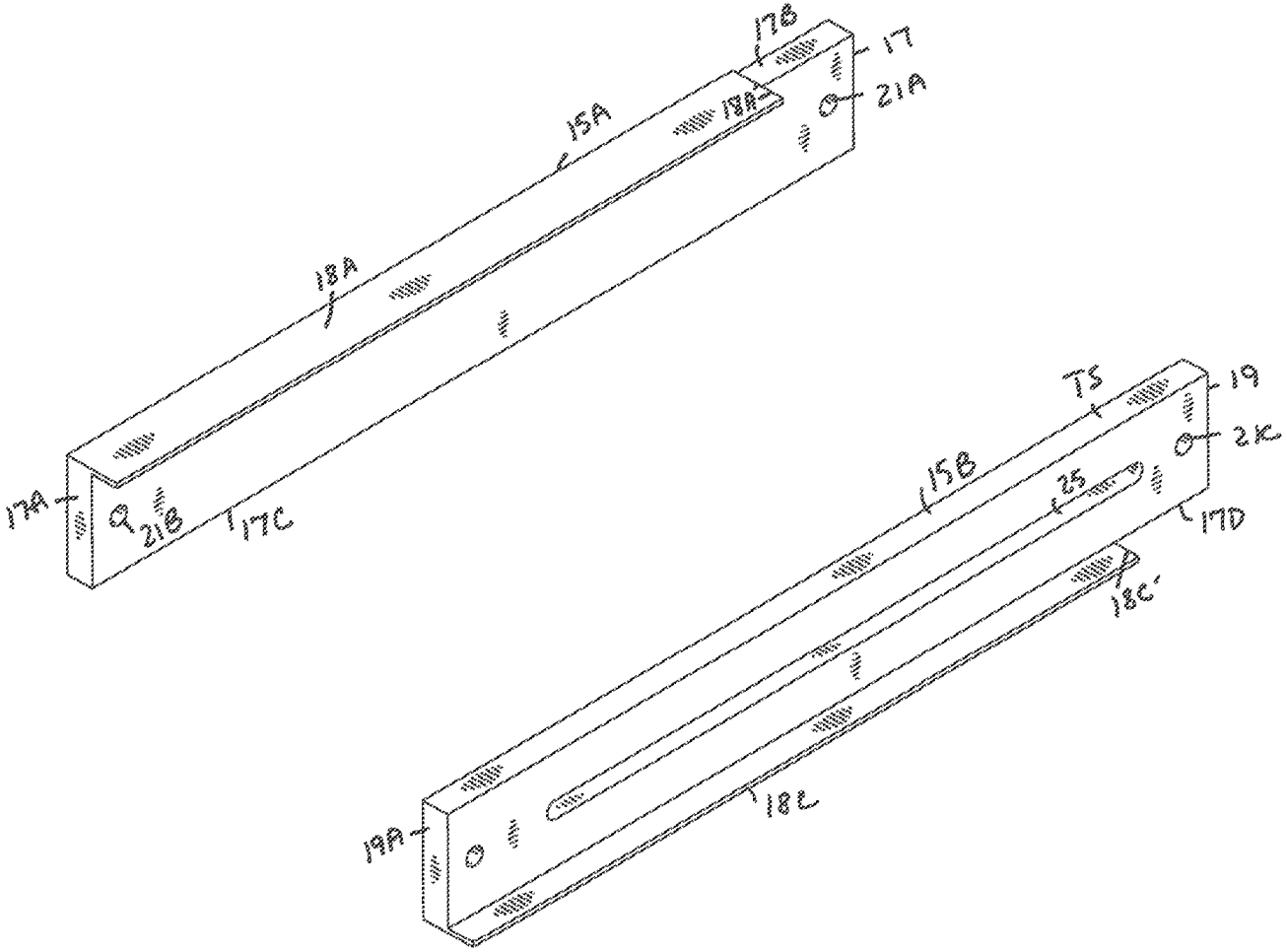
FIG. 8 shows the first and second parts of the template device and further illustrates an alternate embodiment with the top and bottom edges.

In the alternative, and referring to FIG. 8, the first part 15A includes the defined top side 17B having the appropriately attached top edge 18A as described. However as illustrated, the second part 15B defines a bottom side 170 that extends parallel with axis 5. As shown in FIG. 8, the bottom side 17D includes a bottom edge 18B.

The top edge 18A having the top extending portion 18A' that horizontally extends past the edge of the top side. And similarly, the bottom edge 18B defines a bottom extending portion 18B' that horizontally extends past the edge of the bottom side. The top extending portion 18A' and the bottom extending portion 18B' being in parallel relation.

In application, the top extending portion 18A' remains in slidingly frictional engagement with the top surface TS of the second part 15B, and the bottom extending portion 18B' remains in slidingly frictional engagement with the bottom surface 17C of the first part 15A. As should be understood, in this embodiment, the portions 18A' and 18B' maintain and guide the parts 15A, 15B while adjusting the length of the extendable base 15 as described.

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A template device comprising:

an extendable base having a first swivel and a second swivel, and wherein said extendable base being extendable along a longitudinal axis and wherein said first and second swivels generally being vertically adjustable in perpendicular relation to said axis, said extendable base includes a generally rectangular first part that includes a first end, a first aperture positioned adjacent the first end, and a second aperture disposed at a second end that is opposite said first end, said first aperture for appropriately attaching said first swivel to said first part, said extendable base further includes a second part which defines a slot having a width sized for frictionally receiving a threaded bolt, said slot defining a slot length that extends about the approximate length of the second part, said slot length is parallel to said axis, said second part further includes a third aperture disposed between said slot and a first end of said second part for appropriately attaching said second swivel to said second part such that said first and second swivels are disposed on opposite ends of the extendable base, and wherein said first swivel extends a first swivel distance past said first part's first end, and said second swivel extends a second swivel distance past said second part's first end, and said first swivel distance is approximately equal to said second swivel distance, said slot sized and shaped for allowing said threaded bolt to slide along the slot length, and wherein the second part attaches to the first part by inserting the threaded bolt through the slot of the second part and through the second aperture of the first part and securing with a nut such that the extendable base is horizontally expandable by positioning the threaded bolt along the length of the slot, said first swivel includes first, second, third and fourth sides, wherein said first swivel's first side has the approximate same height as a height of said extendable base, and wherein said first swivel's first side extends in a straight line and is generally perpendicular to the longitudinal axis and is configured to be in contact with a back side of said second end of said second part to square up the first swivel with the first part, and said first swivel's second side is perpendicular to said first swivel's first side and is generally parallel with said longitudinal axis, and said first swivel's fourth side is perpendicular to said first swivel's first side and generally parallel with said longitudinal axis, and wherein a length of said first swivel's first side is substantially less than a length of said first swivel's second side, and said first swivel's third side extends from an end of said first swivel's second side to an end of said first swivel's fourth side and defines a first swivel angle, said first swivel further defines a first swivel aperture adjacent said first swivel's first side, and said first swivel aperture is approximately centrally disposed between said first swivel's second and fourth sides, and wherein a first swivel aperture distance is defined between said first swivel aperture and said first swivel's fourth side, and wherein said first swivel aperture distance is equal to or greater than a length of said first swivel's fourth side, and wherein said first swivel aperture distance is less than said length of said first swivel's second side, said first swivel's third side defining upper and lower tracing angles, and said second swivel has defined first, second, third and fourth sides, and wherein said second swivel's first side has the approximate same height as the height of said extendable base, and wherein said second swivel's first side extends in a straight line and is generally perpendicular to the longitudinal axis, and said second swivel's second side is perpendicular to said second swivel's first side and is generally parallel with said longitudinal axis, and said second swivel's fourth side is perpendicular to said second swivel's first side and generally parallel with said longitudinal axis, and wherein a length of said second swivel's first side is substantially less than a length of said second swivel's second side, and said second swivel's third side extends from an end of said second swivel's second side to an end of said second swivel's fourth side and defines a second swivel angle, said second swivel further defines a second swivel aperture adjacent said second swivel's first side, and said second swivel aperture is approximately centrally disposed between said second swivel's second and fourth sides, and wherein a second swivel aperture distance is defined between said second swivel aperture and said second swivel's fourth side, and wherein said second swivel aperture distance is equal to or greater than a length of said second swivel's fourth side, and wherein said second swivel aperture distance is less than said length of said second swivel's second side, and said second swivel's third side defining upper and lower tracing angles.

2. The template device of claim 1, wherein said first swivel angle is an approximate 45 degree angle.

3. The template device of claim 1, wherein said second swivel angle is an approximate 45 degree angle.

4. A template device comprising:

a base having a first swivel and a second swivel, and wherein said base being extendable along a longitudinal axis and wherein said first and second swivels generally being vertically adjustable in perpendicular relation to said axis, said base includes a first part having a first aperture positioned adjacent a first end and a second aperture disposed at a second end that is opposite said first end, said first aperture for appropriately attaching said first swivel to said first part, said base further includes a second part that defines a slot having a slot length that extends the approximate length of the second part, said slot length is parallel to said axis, said second part further includes a third aperture disposed between said slot and a first end of said second part for appropriately attaching said second swivel to said second part, said slot sized and shaped for allowing a stud member to slide along the slot length, and wherein the second part configured to attach to the first part by inserting the stud member through the slot of the second part and through the second aperture of the first part and appropriately securing such that the base is horizontally expandable by positioning the stud member along the length of the slot, said first swivel includes first, second, third and fourth sides, and further defines a first swivel aperture adjacent said first swivel's first side, and said first swivel aperture is approximately centrally disposed between said first swivel's second and fourth sides, and wherein a first swivel aperture distance is defined between said first swivel aperture and said first swivel's fourth side, and wherein said first swivel aperture distance is equal to or greater than a length of said first swivel's fourth side, said first swivel's first side extends in a first straight line and is configured to be in contact with a back side of said second end of said second part to square up the first swivel with the first part, and said third side defines upper and lower tracing angles, and said second swivel has defined first, second, third and fourth sides, and further defines a second swivel aperture adjacent said second swivel's first side, and said second swivel aperture is approximately centrally disposed between said second swivel's second and fourth sides, and wherein a second swivel aperture distance is defined between said second swivel aperture and said second swivel's fourth side, and wherein said second swivel aperture distance is equal to or greater than a length of said second swivel's fourth side, and said second swivel's first side extends in a second straight line, and said third side defines first and second tracing angles.

5. The template device of claim 4, wherein said first and second swivels are disposed on opposite ends of the base.

6. The template device of 5, wherein said first swivel extends a first swivel distance past said first part's first end, and said second swivel extends a second swivel distance past said second part's first end, and said first swivel distance is approximately equal to said second swivel distance.

7. The template device of claim 6, wherein said first swivel's first side has the approximate same height as a height of said base, and wherein said first swivel's first side is generally perpendicular to the longitudinal axis, and said first swivel's second side is perpendicular to said first swivel's first side and is generally parallel with said longitudinal axis, and said first swivel's fourth side is perpendicular to said first swivel's first side and generally parallel with said longitudinal axis, and wherein a length of said first swivel's first side is substantially less than a length of said first swivel's second side, and said first swivel's third side extends from an end of said first swivel's second side to an end of said first swivel's fourth side and defines a first swivel angle.

8. The template device of claim 7, wherein said first swivel aperture distance is less than said length of said first swivel's second side.

9. The template device of claim 8, wherein said first swivel angle is an approximate 45 degree angle.

10. The template device of claim 9, wherein said second swivel's first side has the approximate same height as the height of said extendable base, and wherein said second swivel's first side is generally perpendicular to the longitudinal axis, and said second swivel's second side is perpendicular to said second swivel's first side and is generally parallel with said longitudinal axis, and said second swivel's fourth side is perpendicular to said second swivel's first side and generally parallel with said longitudinal axis, and wherein a length of said second swivel's first side is substantially less than a length of said second swivel's second side, and said second swivel's third side extends from an end of said second swivel's second side to an end of said second swivel's fourth side and defines a second swivel angle.

11. The template device of claim 10, wherein said second swivel aperture distance is less than said length of said second swivel's second side.

12. The template device of claim 11, wherein said second swivel angle is an approximate 45 degree angle.

13. The template device of claim 4, wherein said stud member is a threaded bolt.

14. The template device of claim 13, wherein the second part is secured to the first part with said threaded bolt and a nut.

15. The template device of claim 14, wherein said nut is a wing nut.

16. A method for using a template device in determining angles, which comprises:

matching the device to a structure's angle to be determined by adjusting the length of an extendable base to the structure's angle, said extendable base including a first swivel and a second swivel, and wherein said base being extendable along a longitudinal axis and wherein said first and second swivels generally being vertically adjustable in perpendicular relation to said axis, and wherein said first swivel includes first, second, third and fourth sides, and wherein a first swivel aperture distance is defined between a first swivel aperture and said first swivel's fourth side, and wherein said first swivel's aperture distance is equal to or greater than a length of said first swivel's fourth side, and wherein said first swivel's first side extends in a first straight line and is configured to be in contact with a back side of a first end of said extendable base to square up said first swivel with said first end, and said first swivel's third side defines upper and lower tracing edges, and wherein said second swivel has defined first, second, third and fourth sides, wherein a second swivel aperture distance is defined between a second swivel aperture and said second swivel's fourth side, and wherein said second swivel's aperture distance is equal to or greater than a length of said second swivel's fourth side, and wherein said second swivel's first side extends in a second straight line, and said second swivel's third side defines upper and lower tracing edges, abutting the third side of the second swivel with the structure's first surface, abutting the third side of the first swivel with the structure's second surface thereby positioning the first swivel and the second swivel to match the angle to be determined, securing the first and second swivel positions, removing the device from the structure, aligning a corner end of said first swivel with a front edge of a material to be cut, aligning a corner end of said second swivel with said front edge of said material to be cut, tracing the determined angle along the tracing edge of the first swivel.

17. The method of claim 16, including the step of tracing along the tracing edge of the second swivel.

* * * * *